US005861588A

United States Patent [19]

Gillot

[11] Patent Number: 5,861,588

[45] Date of Patent: Jan. 19, 1999

[54] PLANE MECHANICAL KEYBOARD

[75] Inventor: Jean-Loup Gillot, Paris, France

[73] Assignee: France Telecom, Paris, France

[21] Appl. No.: 846,619

[22] Filed: Apr. 30, 1997

[30] Foreign Application Priority Data

May 2, 1996 [FR] France ..... 96 05515

[51] Int. Cl.[6] ..... H01H 13/70; B41J 5/00; G06C 7/02

[52] U.S. Cl. ..... 200/5 A; 235/145 R

[58] Field of Search ..... 200/5 R, 5 A, 200/512, 341; 341/22, 26; 235/145 R; 364/709.15; 400/485

[56] References Cited

U.S. PATENT DOCUMENTS

| | | | |
|---|---|---|---|
| 4,400,593 | 8/1983 | Kunz | 200/5 A |
| 4,566,078 | 1/1986 | Crabtree | 704/8 |
| 4,649,246 | 3/1987 | Schmid et al. | 200/5 A X |
| 5,124,702 | 6/1992 | Van Ardenne | 341/22 |
| 5,528,235 | 6/1996 | Lin et al. | 341/22 |
| 5,612,690 | 3/1997 | Levy | 341/22 |

FOREIGN PATENT DOCUMENTS

A-2729157 1/1979 Germany .

*Primary Examiner*—J. R. Scott
*Attorney, Agent, or Firm*—Nilles & Nilles SC

[57] ABSTRACT

A plane, mechanical keyboard comprises several main keys, each of which is surrounded by one or more secondary keys and is mechanically connected to at least one of these secondary keys to define a striking zone. Mechanisms interconnect the main keys and the secondary keys so that each main key, under the effect of a pressure, drives the neighboring secondary keys mechanically connected to this main key downwards and so that a pull-back force exerted on each secondary key exerts a corresponding pull-back force capable of drawing the neighboring main key back upwards when there is no pressure exerted on this neighboring key. This keyboard is designed, inter alia, to be integrated into pocket computer devices or pocket electronic devices or again into portable telephones.

30 Claims, 5 Drawing Sheets

FIG. 1A
PRIOR ART
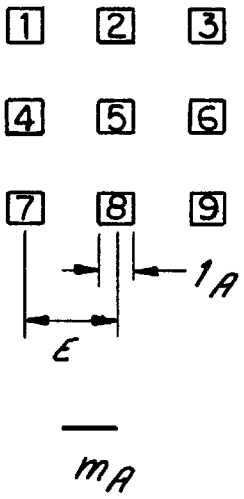
FIG. 1B
PRIOR ART
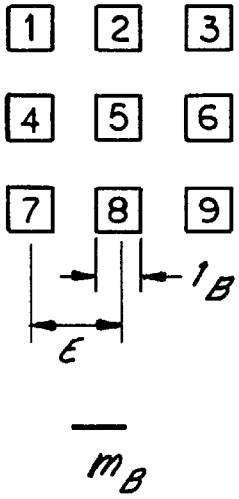
FIG. 1C
PRIOR ART
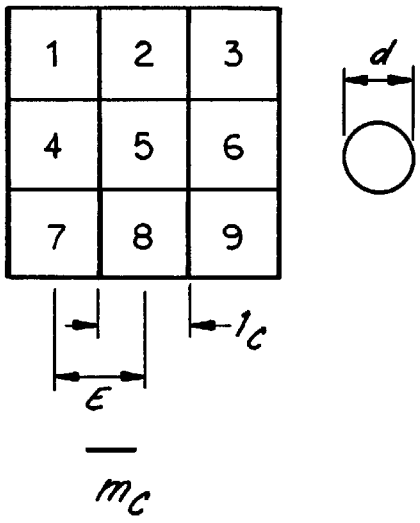
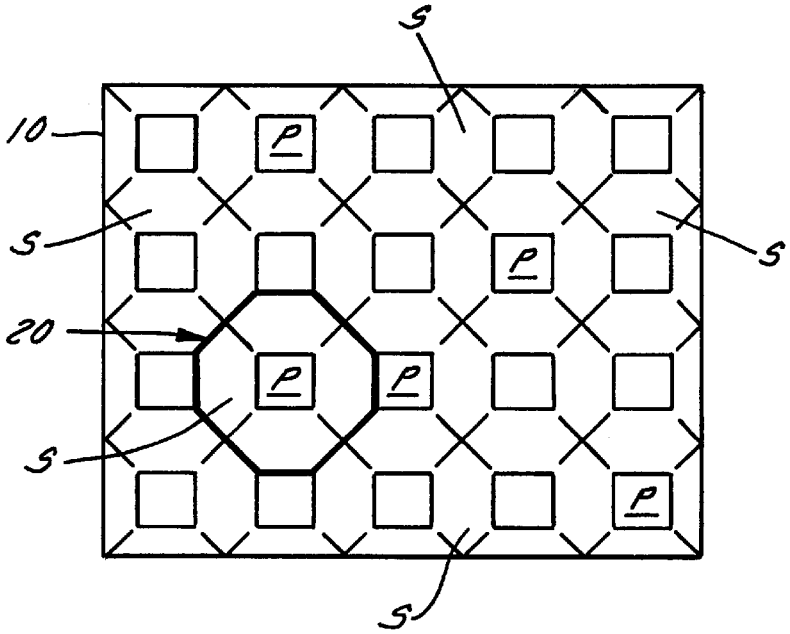
FIG. 2

PLANE MECHANICAL KEYBOARD

BACKGROUND OF THE INVENTION

1. Field of the Invention

The present invention relates to a plane mechanical keyboard designed to be integrated into microcomputer type pocket computers or electronic devices or into portable telephones for example.

2. Description of the Prior Art

Mechanical keyboards are widely available in the market. They include membrane-type keyboards, flexible contact keyboards and also touch pad keyboards.

However, presently existing mechanical keyboards have keys that are far too small to enable the high-speed and efficient typing of a text. For, since the keys have a size that is generally smaller than the contact surface of a user's finger, it becomes impossible to press a key without rubbing against at least one of its angular edges. Consequently, the high-speed and prolonged typing of a text very soon becomes irksome and ergonomically unsound.

Furthermore, the small sizes of the keys and the small interstices between two contiguous keys mean that the typing must be done with very great precision in order to prevent the many typing errors that are likely to occur.

FIGS. 1A to 1C show three types of prior art keyboards. These three keyboards are made to the same dimensions, and the spacing E between the centers of two neighboring keys is constant from one keyboard to another. Only the width of the keys, respectively referenced $l_A$, $l_B$ and $l_C$, varies from one keyboard to another. Now, it is this dimension of the keys that plays a very great role in the value of the margin of error available to the user around the center of a key of a keyboard. The margin of error is geometrically defined as the size of a horizontal or vertical segment on which the center of the finger must be placed in order that the striking of the required key may be valid. This margin is generally inversely proportional to the striking precision.

In general, the value of the spacing E between the centers of two neighboring keys for small-sized keyboards designed for pocket devices ranges from 1 to 1.5 cm.

Furthermore, it is assumed by approximation that the contact surface of an adult finger on a keyboard, when a key is struck, forms a circle whose diameter, designated by the reference d, is estimated at about 0.8 cm. In order that a user may be sure of being able to depress one of the keys of a keyboard by randomly pressing on this keyboard, it is furthermore necessary that the width of the keys of this keyboard should range from E to E-d, namely about 0.2 and 0.7 cm.

FIGS. 1A to 1C show the development of the margin of error, referenced $m_A$, $m_B$ and $m_C$, as a function of the width of the keys. It can be seen that, when the width $l_C$ of the keys is equal to E, the margin of error $m_C$ is the minimum, namely a user must take great care to avoid striking two keys simultaneously.

However, when the width $l_A$ of the keys is the minimum and equal to E-d, then the margin of error is the maximum. In this case indeed, no great precision is required to strike the keys since they are sufficiently spaced out to prevent the possibility that two keys may be struck simultaneously. FIG. 1B illustrates an intermediate example with a value of $l_B$ ranging from E to E-d.

However, the optimum approach shown in FIG. 1A is not ergonomically sound. For, as described earlier, since the striking surface $l^2$ is smaller than the contact surface ($\Pi d^2/4$) of a user's finger, it is impossible to strike a key without rubbing against at least one of its angular edges. Consequently, this type of key cannot be used for the fast and prolonged typing of a text in an efficient manner.

SUMMARY OF THE INVENTION

The present invention is used to resolve all these problems since it proposes a plane mechanical keyboard designed to be integrated into a pocket electronic device, comprising secondary keys between the main keys. These secondary keys are movable and driven downwards by the main keys when these main keys are themselves driven downwards upon being struck by a user's finger. These secondary keys thus increase the striking surface and considerably improve typing comfort since the finger is never in contact with any of the angular edges of the main key.

More particularly, the keyboard according to the invention comprises:

several main keys, each of them being surrounded by one or more secondary keys and being mechanically connected to at least one of these secondary keys to define a striking zone, mechanisms to drive the main keys and the secondary keys so that each main key, under the effect of a pressure, drives the neighboring secondary key or keys mechanically connected to this main key or these main keys downwards and so that each secondary key exerts a pull-back force capable of drawing the neighboring main key or keys that are mechanically connected to it back upwards when there is no pressure exerted on this neighboring key or these neighboring keys.

Through this keyboard, fast prolonged typing no longer raises any difficulty. Furthermore, the fact of increasing the typing surface while keeping an intermediate space between two contiguous main keys, with a width smaller than the diameter of the contact surface of a finger, considerably reduces the necessary precision of striking and makes it possible to avoid typing errors more efficiently.

Furthermore, since a keyboard of this kind has a plane surface, it makes it easier to read the symbols inscribed on the keyboard between two main contiguous keys. Indeed, in standard keyboards, since the keys are raised, when a keyboard is used in an oblique position with respect to the axis of vision of a user's eye, symbols of this kind are partially concealed by the raised keys.

BRIEF DESCRIPTION OF THE DRAWINGS

Other features and advantages of the invention shall appear from the following description given by way of an illustrative and non-exhaustive example, with reference to the appended figures, of which:

FIGS. 1A, 1B, 1C which have already been described respectively pertain to three types of keyboards belonging to the prior art, FIG. 2 shows a top view of a first embodiment of a keyboard according to the invention.

MORE DETAILED DESCRIPTION

Figure 3A:
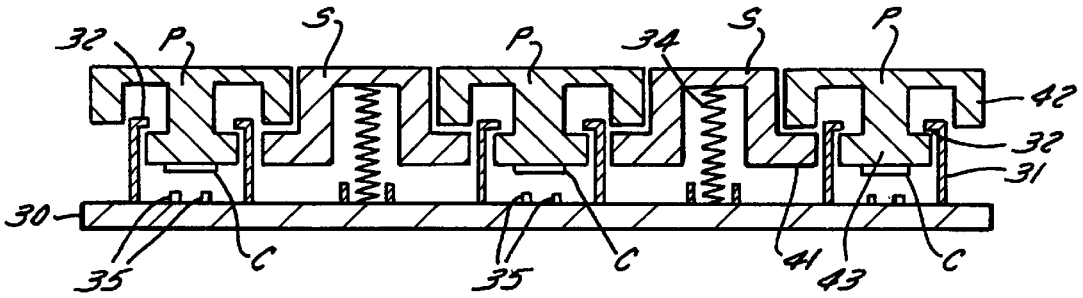
FIGS. 3A and 3B show a sectional view of the keys of the keyboard of FIG. 2, respectively at rest and in a depressed position.

FIG. 2 illustrates a first embodiment of a keyboard according to the invention designated by the reference 10. This keyboard has main keys referenced P that are arranged in matrix form. These main keys are separated from one another by intermediate mobile spaces also called secondary keys and referenced S.

Each key P is therefore surrounded by four keys S. In the examples described here below, the key P is mechanically connected to the four keys S that surround it, but it is quite possible to envisage the making of a keyboard in which each key P is mechanically connected to only one or two or three secondary keys.

In FIG. 2, the secondary keys S have a hexagonal surface, but this shape is not essential, and the keys may have surfaces of any other shape. The main keys P and the secondary keys S are preferably at the same level so that the surface of the keyboard at rest is completely plane.

The four main functions that enable the keys of a standard keyboard to function are the guiding of the keys in their vertical motion, the force of reaction or recoil by which the keys return to the top position, the locking of the keys in the top position and electrical contact. The first two functions listed here above are achieved by means of driving mechanisms.

In the standard keyboards, each of these driving mechanisms is placed beneath each of the keys. In the keyboard 10 according to the invention, these driving mechanisms are advantageously divided between the main keys P and the secondary keys S. This distribution thus enables each main key P to drive its four neighboring secondary keys downwards under the effect of pressure and, conversely, each secondary key S exerts a pull-back force so as to bring its two neighboring main keys back to the top position when no pressure is exerted on these main keys.

Consequently, through this distribution of the driving mechanisms between the two types of keys, the striking surface of a key P is increased and includes not only the main key P but also the four neighboring secondary keys S. This striking surface is designated by the reference 20 in FIG. 2. It is octagonal and demarcated by a heavy black line. Since this surface is plane, when a user types on the corresponding main key P, even if his finger overlaps one or more neighboring secondary keys S, it remains in contact with the plane surface and, unlike in the case of standard keys, does not rub against an angular edge of the key. When the problem of the rubbing of the finger against an angular edge is averted, the size of the main keys may be as small as required. The striking zone 20 thus created is used to considerably reduce the number of typing errors that may occur. A text can be typed at length without any problems for the user.

Advantageously, the size of the main keys is such that it minimizes striking precision, i.e. it increases the margin of error available to a user around the center of a key P. The keys P may, without any difficulty, be smaller than the contact surface of a key since the secondary keys enable the maintaining of a plane striking surface 20. As described here above, the width l of the main keys P preferably ranges from E, namely the value of the spacing between the centers of two contiguous keys P, to E-D. Thus, for example, their surface area ranges from 0.04 to 1 $cm^2$. Of course, this surface can always be widened and may, for example, reach a value equal to 1.5 $cm^2$. However, it is also preferable that the secondary keys S should be small enough for a random striking of the key to cause motion in one main key regardless of the striking zone. Consequently, the width of the secondary keys must be smaller than or equal to the diameter d of the contact surface of a finger. It ranges for example from 0.2 cm to 0.7 cm.

Figure 3B:
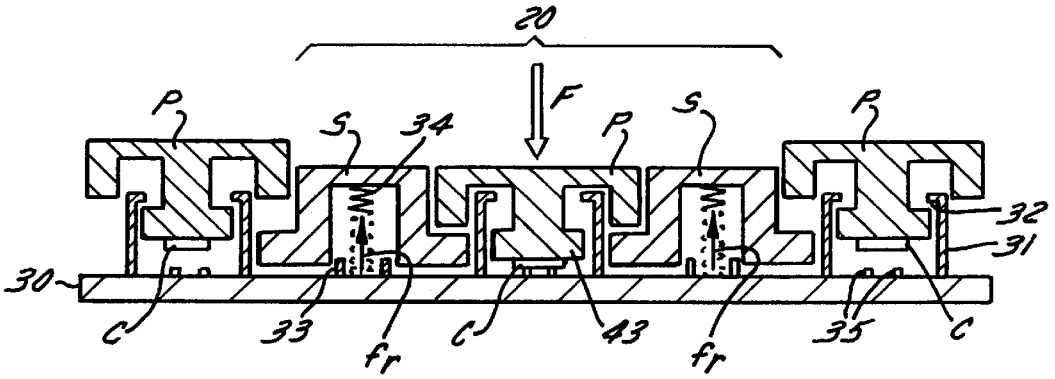

FIGS. 3A and 3B show the driving mechanisms and their distribution beneath the two types of key S and P of the keyboard of FIG. 2. FIG. 3A shows a sectional view of the keys at rest, namely in the top position, while FIG. 3B shows a sectional view of the keys when they are depressed under the action of pressure exerted on a main key.

The main and secondary keys lie on a base 30. In FIG. 3A, the two types of keys have common guides 31.

The guides 31 each have two flanges or snugs 32 at their upper end. These snugs 32 are upward-locking devices. They each act on the shoulder or cylinder 43 of a main key P located between the guides 31 of this key P so as to lock it at the end of its travel when the main key P rises up to the top position under the effect of the pull-back forces exerted beneath the secondary keys.

In one alternative embodiment, it is quite possible to make a keyboard in which the guidance means are specific to each type of key.

Elastic member 34, such as springs for example, are designed solely beneath the secondary keys S so that they exert the pull-back force $f_r$ designed to draw the neighboring main keys P back to the top position.

Furthermore, electrical contacts 35 are designed solely beneath the main keys P to enable the activation of the writing of the corresponding letters inscribed on these keys when the contacts 35 are engaged by contacts C on the main keys in the conventional manner. In principle, it is preferred not to provide for any contact beneath the secondary keys S since these keys are not designed to activate the writing of characters but only to increase the striking zone.

The secondary keys S take the form of an inverted U and, at each end of the arms of the U, they have a tongue 41 to support the neighboring main keys P. These tongues 41 thus enable the driving of the main keys P that they support to the top position under the effect of the pull-back force $f_r$ exerted by the spring 34.

The main keys P take the form of a T and, at each end of the horizontal bar of the T, they have a tongue 42. Each tongue 42 firstly rubs against a guide 31 so as to ensure that the key P is efficiently held in a vertical position when it is depressed and secondly presses on a tongue 41 of a neighboring key S so as to drive this key S downwards when a pressure is exerted on the main key. These tongues 41 and 42 therefore enable the mechanical connection of a main key P to one or more secondary keys S.

FIG. 3B illustrates what happens when a pressure, designated by the letter F and represented by an arrow, is exerted on the central key P. The tongues 42 of the key P then press on the tongues 41 of the neighboring keys S. The key P is depressed and therefore drives along with it the neighboring secondary keys S defining the striking zone while the other two keys P, located on either side of this striking zone, remain in the top position since no pressure is exerted thereon. The depressed key P then sets up a contact with the electrical contacts 35 so as to activate the writing of the character that corresponds to it. The springs 34 placed beneath the secondary keys S of the striking zone are compressed and exert a pull-back force $f_r$. This pull-back force $f_r$ makes it possible, when the pressure F is eliminated, to bring the depressed key P back into the top position.

Figure 4:
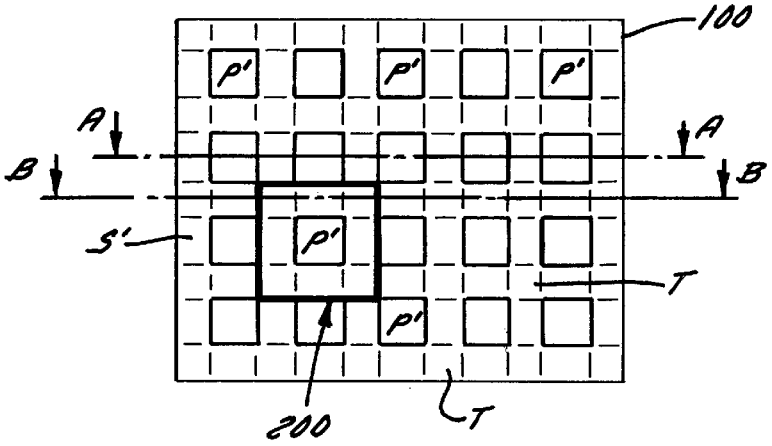
FIG. 4 shows a top view of another keyboard according to the invention.

FIG. 4 shows a second embodiment of a keyboard according to the invention designated by the reference 100. This keyboard also has main keys referenced P' arranged in matrix form.

These keys P' are separated from one another by mobile intermediate spaces. These mobile intermediate spaces are of two types: there are rectangular spaces called secondary keys, referenced S', and square spaces called tertiary keys, referenced T. Each tertiary key T is surrounded by four secondary keys S' and four main keys P'. The keys S' share the sides of the key T and the keys P' share the corners. The shapes of the keys S' and T are not limited to the rectangular and square shapes. They depend in particular on the shape of the main keys as well as on their arrangement which is not necessarily a matrix arrangement.

Keys P', S' and T are all at the same level so that the surface of the keyboard is plane. In this embodiment, the driving mechanisms of the keys are distributed between all three types of keys. Consequently, when a user strikes a key P', this key drives along with it, in its vertical motion, the corresponding striking zone defined by the four neighboring secondary keys S' and the neighboring tertiary keys T. This striking zone is shown by a heavy black line and designated by the reference 200 in FIG. 4.

The driving mechanisms are more particularly arranged so that the main key P' carries out the downward driving of the neighboring secondary keys S' which are mechanically connected to it and in turn drive the four neighboring tertiary keys T that are mechanically connected to them.

In the same way, when no pressure is exerted on the key P', the four tertiary keys T exert a pull-back force at each corner of the striking zone and achieve the upward driving of the four neighboring keys S' that are mechanically connected to it and in turn drive the key P' that they surround and to which they are mechanically connected.

Locking members are used to lock the motion in elevation of the main key P' and stabilize it in the top position. The key P' furthermore enables locking of the elevation of the secondary keys S' which in turn lock the elevation of the tertiary keys T so that all the keys P', S' and T are stabilized in an identical top position giving the keyboard a plane surface.

The width of the keys P' is of the same magnitude as that of the keys P of the keyboard 10 according to the first embodiment.

The dimensions of the secondary keys S' and tertiary keys T are furthermore small enough so that none of them can be driven downwards by a user's finger without at least one of the main keys P' being also driven downwards.

Figure 5A:
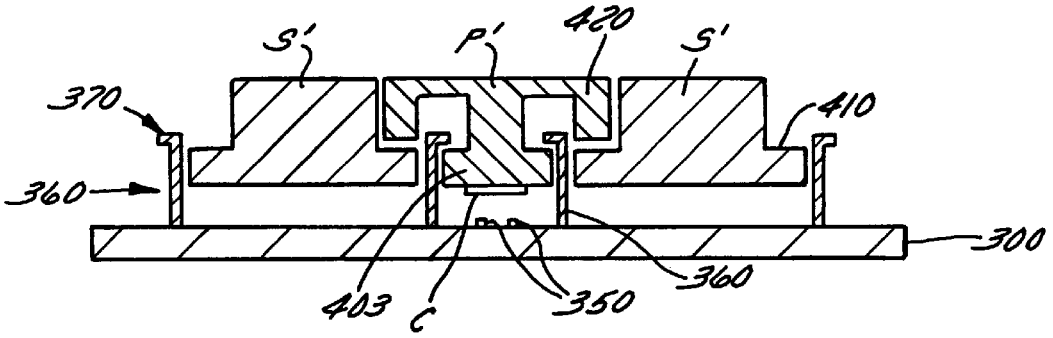
FIGS. 5A and 5B show two sectional views of the keys of the keyboard of FIG. 4 at rest.
Figure 5B:
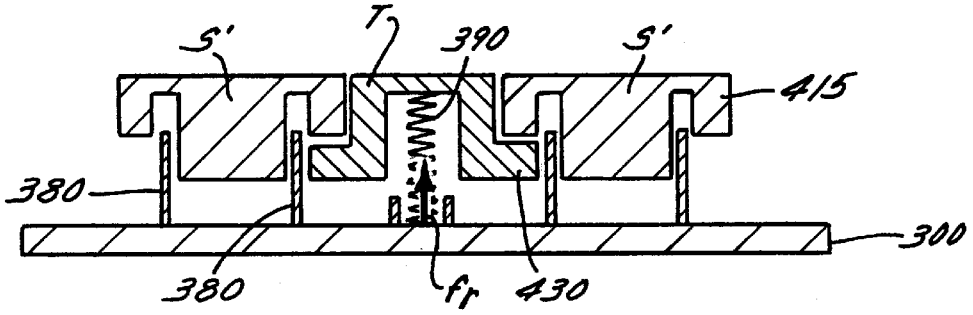

FIGS. 5A and 5B respectively show a sectional view A—A and a sectional view B—B of the keyboard 100 of FIG. 4.

FIG. 5A gives a more special illustration of the relationship between a main key P' and two neighboring keys S'. These two types of keys have common guides 360. Of course, in an alternative embodiment, these guides may be specific to each type of key.

At their upper end, the guides 360 have locking members 370 against which the lower end 403 of the main key P' abuts when it rises to the top position. The main key P' has tongues 420 capable of pushing on the tongues 410 of the secondary keys S' so as to drive them downwards and ensure the vertical holding of the key P' in a rubbing relationship with the guidance means 360. Conversely, the tongues 410 of the keys S' make it possible to push on the tongues 420 of the key P' so as to bring this key back into the top position. These tongues 410 and 420 are used for the mechanical connection of a key P' to one or more secondary keys S'. Electrical contacts 350 are designed on the pedestal 300 beneath the key P'.

FIG. 5B for its part illustrates the relationship between a tertiary key T and two neighboring secondary keys S'. The two types of keys have common guides 380.

An elastic means 390 such as a spring for example is placed beneath the key T. The secondary keys S' have tongues 415 capable of pushing on the tongues 430 of the key T so as to drive this key downwards and provide for the vertical holding of the key S' in a position of friction against the guides 380. When the tertiary key T is depressed, the spring 390 exerts a pull-back force $f_r$. When the pressure exerted on the main key P' is relaxed, the pull-back force $f_r$ enables the tongues 430 of the key T to push on the tongues 415 of the keys S' in order to raise them up to the top position. These tongues 415 and 430 enable the mechanical connection of a secondary key S' with one or more tertiary keys T. The keys S' then draw the key P' with them by means of their tongues 410.

FIGS. 6A to 6D provide for a clearer understanding of the structure of the keyboard 100 as they show top views of a part of this keyboard at different stages of its manufacture.

Figure 6A:
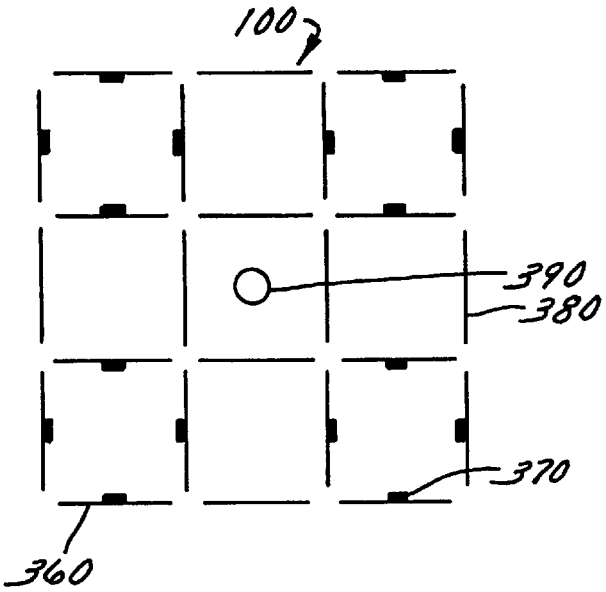
FIGS. 6A to 6D show top views of the keyboard of FIG. 4 at different stages of its manufacture.

FIG. 6A shows the guides 360 common to the main and secondary keys P' and S', the guides 380 common to the main and secondary and tertiary keys S' and T, the locking member 370 of the main keys P' and the spring 390 enabling a pull-back force to be exerted beneath the tertiary key T.

Figure 6B:
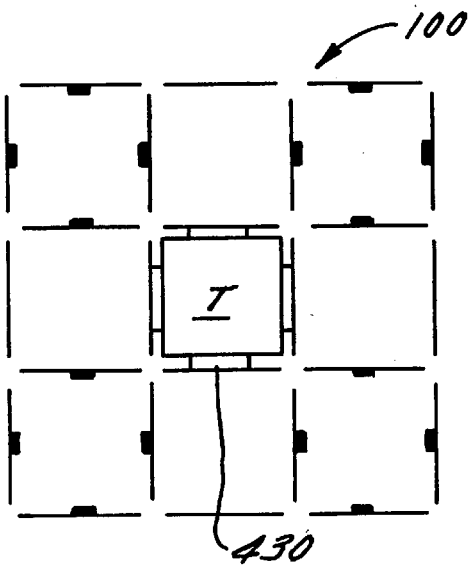
Figure 6C:
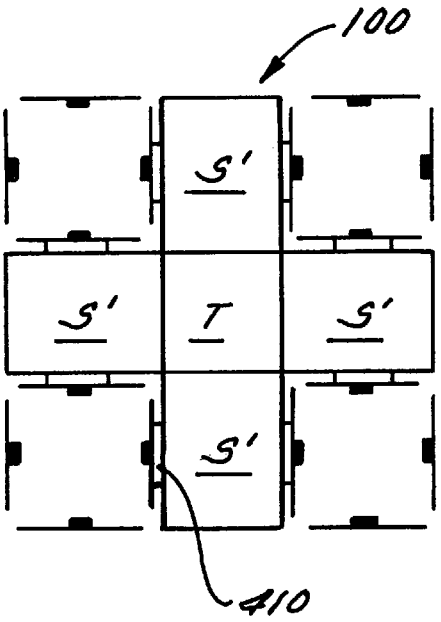
Figure 6D:
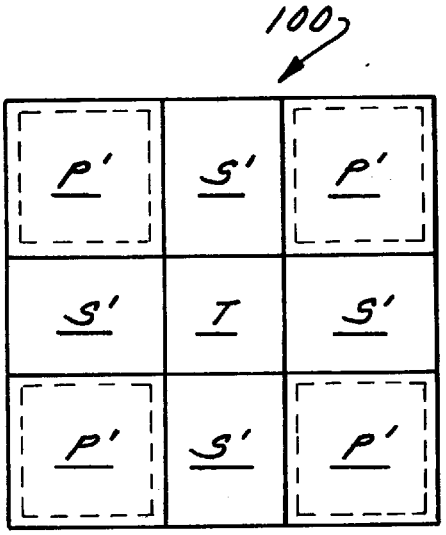

The tertiary key T, comprising tongues 430 to support the secondary keys S' on each of its sides, is placed above its spring 390 (FIG. 6B). Then the secondary keys S', comprising supporting tongues 410 for the main keys P' on two of their sides, are in turn positioned in their respective locations (FIG. 6C). Finally, FIG. 6D illustrates the final stage of manufacture, when the main keys P' are positioned in their housings.

In this type of keyboard 100, when a user strikes two contiguous main keys simultaneously, the resistance to striking is only 1.5 times greater than that of the keyboard when only one key is being struck since the new striking zone encloses six tertiary keys as compared with four for the striking zone of a single key P'. By contrast, in the keyboard 10 according to the first embodiment, the ratio of the resistance values is greater, i.e., 1.75. Indeed, in this case, the zone for the striking of two main keys P has seven secondary keys while the zone for striking only one key P has four of them.

FIGS. 7A to 7D illustrate an alternative embodiment of this keyboard 100.

They show sectional views of the keys of the keyboard when they are depressed. Of course, this variant may also be applied to the keyboard 10.

This variant consists in slightly tilting the contact zones between the main keys and the secondary keys and, similarly, between the secondary keys and the tertiary keys. This makes it possible, when a main key $P_1$ is struck and when the corresponding striking zone is depressed, for the sixteen main keys and neighboring secondary keys to tilt slightly towards the striking zone and simulate an elastic bending of these keys surrounding the striking zone during the motion of this striking zone. Furthermore, this tilting of sixteen neighboring keys of the striking zone provides a slightly concave shape that is complementary to the convex shape of a finger.

Figure 7A:
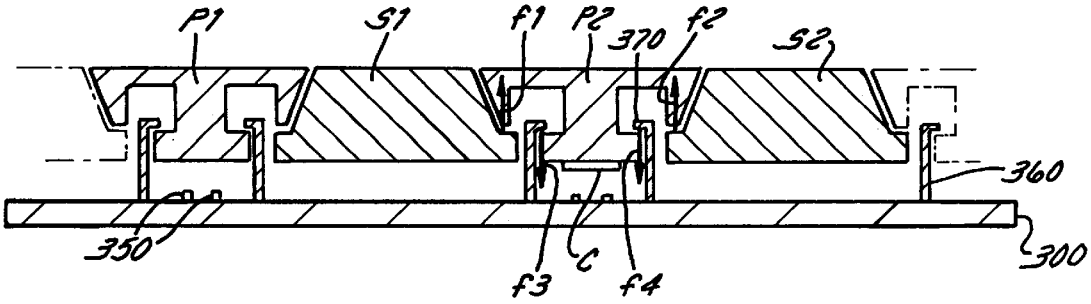
FIGS. 7A to 7D show sectional views of the keys of another embodiment of a keyboard according to the invention.
Figure 7B:
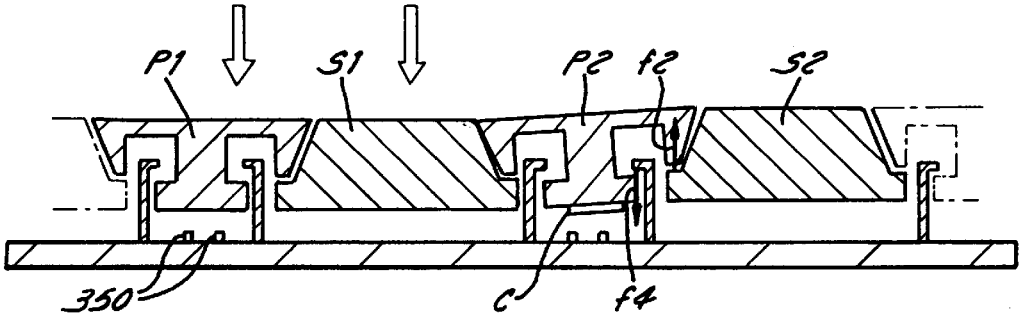

It can indeed be seen in FIG. 7B that when the key $S_1$ is depressed, under the effect of the key $P_1$ or possibly under the direct pressure of a user's finger, the main key $P_2$ which is no longer supported laterally except by the secondary key $S_2$ pivots slightly towards the secondary key $S_1$ under the effect of the pairs of forces ($f_2$, $f_4$) respectively exerted by $S_2$ and by the locking member 370.

Figure 7C:
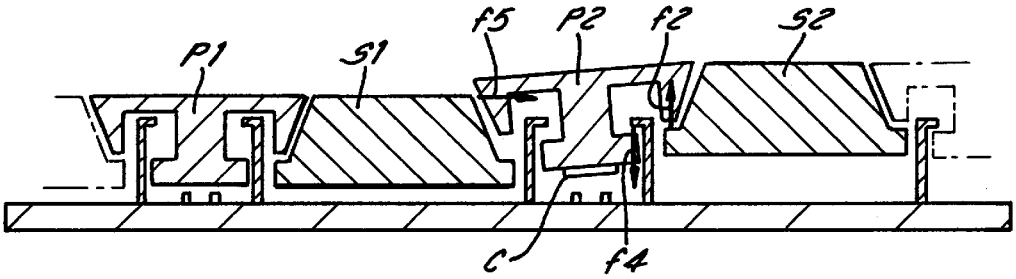
Figure 7D:
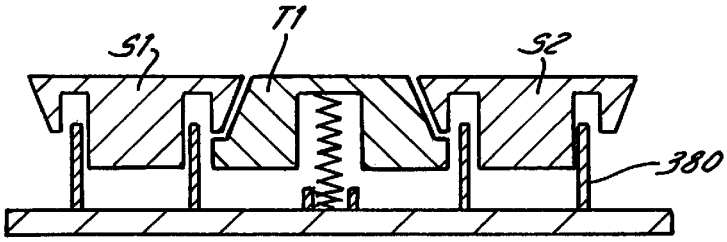

For the same reason, the secondary keys in the neighborhood of the striking zone also tilt towards their tertiary neighbor belonging to this striking zone. FIG. 7C shows the keys $P_1$ and $S_1$ when they are completely depressed. In this case, an additional force $f_5$ exerted by secondary key $S_1$ on the main key $P_2$ enables this key $P_2$ to be stabilized in its tilted position. FIGS. 7A and 7D show the three types of keys $P_1$, $S_1$ and $T_1$ at rest when all the pairs of forces ($f_1$, $f_3$) and ($f_2$, $f_4$) are balanced.

This alternative embodiment has a great advantage. Indeed, if the position of the finger that strikes a striking zone is sufficiently off-centered at the time of striking to graze one of the main neighboring keys of the striking zone, after the tilting of this key, the oblique position that it would have taken will prevent the possibility of an electrical contact at the end of travel with the contacts 350 placed on the pedestal 300 of the keyboard. Consequently, the margin of error available for the striking action is further increased.

Figure 8:
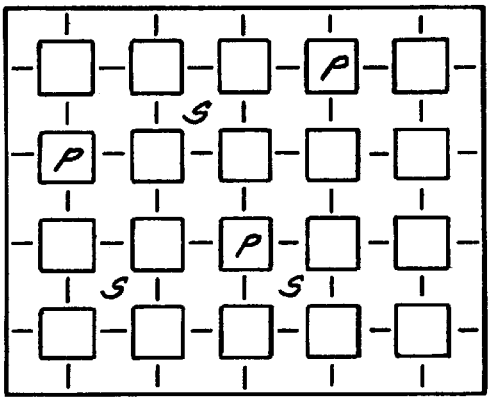
FIG. 8 shows a top view of a keyboard according to an alternative embodiment.

The shape of the surface of the keys $S_1$ and $T_1$ defining the intermediate space is not essential. It may equally well be hexagonal, square-shaped, crossshaped, etc. It is this shape that determines the number of secondary and/or tertiary keys with respect to the number of main keys. Thus, in FIG. 8, which illustrates a variant of a keyboard, the number of cross-shaped secondary keys is equal to the number of main keys.

The number of secondary keys S, mechanically connected to a main key P and the number of tertiary keys T mechanically connected to a secondary key S are not essential either. They are at least equal to 1. In the examples referred to in the description, these numbers are the maximum and are respectively equal to the number of keys S surrounding a key P and to the number of keys S surrounding a key T.

Nor is the shape of the main keys limited to the square shape. It may also be circular, hexagonal or diamond-shaped for example.

An alternative embodiment furthermore consists in slightly undulating the surface of the keyboard so as to improve striking comfort. For this purpose, the main keys have a slightly concave shape which is complementary to that of the finger. Besides, the secondary keys and the tertiary keys, when they are provided, have a convex shape so that there is no break in slope. The surface of the keyboard therefore has a doubly undulating appearance along the vertical and horizontal axes. The horizontal axis is defined by the axis crossing the keyboard from left to right and the vertical axis by the axis crossing the keyboard from top to bottom.

Another alternative embodiment consists in combining the entire intermediate space between the main keys into a single secondary key capable of being driven downwards by each of the main keys. This single secondary key is brought upwards by several springs placed for example at its four ends. In this case, the main keys too are fitted out with springs of low tension so that the keys that are not depressed at the time of striking remain in the top position. The advantage of this variant is simplicity since the resistance to striking is practically independent of the number of main keys that are struck simultaneously owing to the great resistance related to the secondary key. On the contrary, it has the drawback of providing greater inertia at the time of striking and when the secondary key is put into motion, namely it requires greater striking energy on the part of the user.

According to another alternative embodiment, it is possible, beneath the main keys of one of the keyboards described here above, to add stretched springs capable of pulling these main keys downwards. In this case, the resistance to striking is more homogenous. Indeed, for a pull-back force f exerted by the springs located beneath the secondary keys, and for a pull-back force f'=k*f exerted by the springs located beneath the main keys, the force of reaction r1 opposite to the striking zone of a single main key is equal to: r1=(4−k)*f, while the force of reaction r2 opposite to the striking zone of two main keys is equal to: r2=(6−2k)*f. The ratio of these two forces is therefore equal to:

$$R=r2/r1=(6-2k)/(4-k)$$

When there is no stretched spring beneath the main keys, namely when k=0, then R is equal to 1.5. This value of R becomes equal to 1.33 when k=1. This improves homogeneity between the single keys (when a single key P is struck) and the double keys (when two keys P are struck).

In order that R may be equal to 1, k should be equal to 2, but this is impossible since k must remain smaller than [(l+1)*(c+1)]/(l*c) where l and c are respectively the number of rows and columns of the keyboard and [(l+1)*(c+1)] equals the number of secondary keys so that the main force drawing the keyboard at rest downwards is not greater than the force pushing it upwards.

Furthermore, an embodiment of this kind also makes it possible, if the contact zones between the keys are tilted, to considerably increase the lever force driving the keys neighboring the striking zone towards this zone. Indeed, the stretched springs draw these keys downwards and in addition have a far greater lever arm than that available to the force f2 exerted by the key S2 of the keyboard of FIG. 7B.

What is claimed is:

1. A plane mechanical keyboard designed to be integrated into an electronic pocket device comprising:

several main keys, each of which is located adjacent to at least one neighboring secondary key, means for mechanically interconnecting each of the main keys with the associated neighboring secondary key to form a striking zone, the means for interconnecting coupling the main keys to the associated neighboring secondary keys such that an application of a pressure to one of the main keys drives the associated neighboring secondary key downwards and so that application of a pull-back force on one of the secondary keys exerts a corresponding pull-back force on the associated neighboring main key.

2. A mechanical keyboard according to claim 1, further comprising means for locking the main keys from excessive upward movement.

3. A mechanical keyboard according to claim 1, wherein the means for interconnecting includes:

guidance means for vertically guiding at least one of the main keys and the secondary keys, elastic means, placed beneath the secondary keys, for exerting the pull-back force on the secondary keys.

4. A mechanical keyboard according to claim 1, wherein the means for interconnecting comprises tongues on the secondary keys that support the neighboring main keys.

5. A mechanical keyboard according to claim 1, further comprising a plurality of tertiary keys, each of which is surrounded by four secondary keys and four main keys and each of which is connected mechanically to at least one secondary key, and wherein the means for interconnecting interconnects the main keys, the secondary keys, and the tertiary keys in such a way that 1) downward movement of one of the main keys drives the neighboring secondary key downward and such that downward movement of one of the secondary keys drives the neighboring tertiary key downward, and 2) application of a pull-back force on one of the tertiary key exerts a corresponding pull-back force on the neighboring secondary and main keys associated therewith.

6. A mechanical keyboard according to claim 5, further comprising means for locking the main keys from excessive upward movement.

7. A mechanical keyboard according to claim 5, wherein the driving mechanisms comprise:

guidance means for vertically guiding at least one of the main keys and the secondary keys, elastic means, placed beneath the tertiary keys, for exerting the pull-back force on the tertiary keys.

8. A mechanical keyboard according to claim 5, wherein the secondary keys include support tongues that support the neighboring main keys and that form a first portion of the means for interconnecting, and wherein the tertiary keys include support tongues that support the neighboring secondary keys and that form a second portion of said means for interconnecting.

9. A mechanical keyboard according to claim 5, wherein contact zones are formed between the main keys and the secondary keys and between the secondary keys and the tertiary keys and are slightly tilted so that, when a main key is struck, the contact zones simulate an elastic deformation of the neighboring keys of the corresponding striking zone.

10. A mechanical keyboard according to claim 1, further comprising fixed electrical contacts positioned beneath the main keys in a spaced-apart relationship with respect to the main keys.

11. A mechanical keyboard according to claim 1, wherein the dimensions of the secondary keys are small enough for none of them to be capable of being driven downwards by a user's finger without one of the neighboring main keys also driven downwards.

12. A mechanical keyboard according to claim 1, wherein an upper surface of each of the main keys is slightly concave and an upper surface of each of the secondary keys is slightly convex.

13. A mechanical keyboard according to claim 1, wherein the guide means guide the main keys only.

14. A plane mechanical keyboard designed to be integrated into an electronic pocket device, said mechanical keyboard comprising:

(A) a base;

(B) a plurality of main keys which are supported on said base so as to be movable vertically with respect to said base;

(C) a plurality of secondary keys, each of which 1) is supported on said base so as to be movable vertically with respect to said base and 2) is located adjacent at least one main key so as form a neighboring secondary key; and (D) at least one return element; wherein each of said main keys is operatively connected to at least one neighboring secondary key associated therewith such that, with respect to each said main key, 1) downward movement of said main key with respect to said base effects downward movement of said neighboring secondary key with respect to said base, and 2) a return force, imposed on said neighboring secondary key by said return elements is transmitted through said neighboring secondary key to said main key, thereby biasing said main key upwardly with respect to said base.

15. A mechanical keyboard according to claim 14, further comprising a stop which prevents excessive upward movement of at least one of said main keys relative to said base.

16. A mechanical keyboard according to claim 14, further comprising a plurality of guides each of which guides at least one of said main keys for vertical movement with respect to said base.

17. A mechanical keyboard according to claim 16, wherein said guides guide said main keys only.

18. A mechanical keyboard according to claim 14, wherein each of said secondary keys includes at least one tongue which supports a neighboring main key.

19. A mechanical keyboard according to claim 14, wherein the return element comprises a spring extending from said base to said neighboring secondary key.

20. A mechanical keyboard according to claim 14, wherein each said main key and the neighboring secondary key associated therewith have complementarily sloped adjacent surfaces.

21. A mechanical keyboard according to claim 14, wherein an upper surface of each of said main keys is concave and an upper surface of each of said secondary keys is convex.

22. A plane mechanical keyboard designed to be integrated into an electronic pocket device, said mechanical keyboard comprising:

(A) a base;

(B) a plurality of main keys which are supported on said base so as to be movable vertically with respect to said base;

(C) a plurality of secondary keys, each of which 1) is supported on said base so as to be movable vertically with respect to said base and 2) is located adjacent at least one main key so as form a neighboring secondary key;

(D) a plurality of tertiary keys, each of which is 1) is supported on said base so as to be movable vertically with respect to said base and 2) is located adjacent at least one neighboring secondary key so as form a neighboring tertiary key; and (E) at least one return element, wherein said main keys, secondary keys, and return keys are interconnected such that, with respect to each said main key, 1) downward movement of said main key with respect to said base effects downward movement of said neighboring secondary key and said neighboring tertiary key with respect to said base, and 2) a return force, imposed on said neighboring tertiary key by said return element, is transmitted through said neighboring tertiary key, through said neighboring secondary key, and to said main key, thereby biasing said main key upwardly with respect to said base.

23. A mechanical keyboard according to claim 22, further comprising a stop which prevents excessive upward movement of at least one of said main keys relative to said base.

24. A mechanical keyboard according to claim 22, further comprising a plurality of guides each of which guides at least one of said main keys for vertical movement with respect to said base.

25. A mechanical keyboard according to claim 24, wherein said guides guide said main keys only.

26. A mechanical keyboard according to claim 22, wherein each of said secondary keys includes at least one tongue which supports a neighboring main key, and wherein each of said tertiary keys includes at least one tongue which supports a neighboring secondary key.

27. A mechanical keyboard according to claim 22, wherein the return element comprises a spring extending from said base to said neighboring tertiary key.

28. A mechanical keyboard according to claim 22, wherein at least one of said main keys and the associated neighboring secondary key have complementarily sloped adjacent surfaces, and wherein at least one of said secondary keys and the associated neighboring tertiary key have complementarily sloped adjacent surfaces.

29. A mechanical keyboard according to claim 22, wherein an upper surface of each of said main keys is concave, an upper surface of each of said secondary keys is convex, and an upper surface of each of said tertiary keys is convex.

30. A mechanical keyboard according to claim 22, wherein each of said tertiary keys is surrounded by four secondary keys and four main keys.

* * * * *